US005716286A

United States Patent [19]

Swan

[11] Patent Number: 5,716,286

[45] Date of Patent: Feb. 10, 1998

[54] GOLF PUTTER ALIGNMENT TEACHING DEVICE

[76] Inventor: John B. Swan, 139 Idlewell Blvd., Weymouth, Mass. 02188

[21] Appl. No.: 693,409

[22] Filed: Aug. 7, 1996

[51] Int. Cl.[6] ..... A63B 69/36

[52] U.S. Cl. ..... 473/175; 473/180; 473/229; 473/251; 473/252; 473/238; 273/DIG. 21

[58] Field of Search ..... 473/229, 238, 473/244, 251, 252, 253, 254, 180, 175; 273/DIG. 21

[56] References Cited

U.S. PATENT DOCUMENTS

| | | | |
|---|---|---|---|
| 1,536,512 | 5/1925 | McLaren | 473/238 |
| 3,298,693 | 1/1967 | Eisenberg | 473/238 |
| 3,604,711 | 9/1971 | Hansburg | 273/DIG. 21 |
| 5,022,656 | 6/1991 | Tiller | 473/229 |

*Primary Examiner*—George J. Marlo
*Attorney, Agent, or Firm*—William Nitkin

[57] ABSTRACT

A training device for golf putting, said device being removably securable to a golf putter having a putter face and vertically disposed shaft, said device comprising:

clamping means for removably securing said teaching device in a generally horizontally plane, said alignment member including an elongate portion for longitudinally axial alignment with a longitudinal axis of the putter face;

elongated flexible guide means secured to said elongate portion of said alignment member for guiding a golf ball to a target; and means for tensioning said guide means and maintaining tension on said guide means from said alignment member to the target during a stroke of the putter.

8 Claims, 5 Drawing Sheets

10
12
14
18
16
20
22
26
27
24

GOLF PUTTER ALIGNMENT TEACHING DEVICE

BACKGROUND OF THE INVENTION

1. Field of the Invention

The device of this invention resides in the area of golf putting devices and more particularly relates to a teaching device which can indicate to a golfer by visual observation thereof whether the putter face is properly aligned perpendicular to the desired direction of movement of the golf ball and also give, during the putting stroke, instant visual feedback as to the proper swing plane of the putter.

2. Description of the Prior Art

The prior art discloses many structures to teach proper stroking of a golf putter. Some of the devices fall within a group that seeks to create and develop muscle memory by controlling the movement of the putter so that the golfer will repeat the same movement of the putter without the guiding structure disposed at the end of the putter. Such devices are found, for example, in U.S. Pat. Nos. 4,334,684 and 5,125,844. Another type of device which is found in the prior art utilizes an extension attached to the putter which the golfer aligns with the desired direction of travel of the golf ball. Such devices using fixed extending members from the putter to be aligned with the direction of travel of the ball are found in U.S. Pat. Nos. 5,351,962 and 5,499,817. The extension remains fixed to the club, and the golfer places the extension parallel to the proposed direction of movement of the putter. Then when putting, the golfer tries to retain the alignment device parallel to the desired direction of movement of the ball. Another device to aid the golfer in putting a golf ball is found in U.S. Pat. No. 3,033,574 where a structure is clipped onto the shaft of the putter club, such device having a straight edge which is first aligned parallel to the front face of the putter blade. The device then has a pointer that is rotated 90 degrees to the straight edge portion of the device which pointer the golfer would then align in the direction of the cup which pointer usually would then aid in aligning the front face of the putter blade to be disposed at a right angle to the imagined line between the pointer and the cup.

SUMMARY OF THE INVENTION

It is an object of this invention to provide a teaching aid to golfers to assist them in learning to putt a golf ball properly. The device uses visual feedback to create muscle memory during the set-up and stroke of the ball. It also teaches a golfer to keep his eyes on the ball during the complete swing of the putter. It is important to note that this device does not restrict the swing of the putter in any way and allows a golfer to learn the correct putting stroke with his natural swing. The device teaches that a good putting stroke consists of both a straight back-and-forth motion to the target and perpendicular (square to target) contact of the ball with the face of the putter towards the target. Many golfers have trouble with one or both of the above, causing the ball to go off the desired target line and miss the target.

It is a further object of this invention to provide an improved device for use in aligning the face of a golf putter to be perpendicular to the proper direction of travel of a golf ball to the cup. This perpendicular alignment of the putter face causes the golf ball to be struck squarely and to move accurately aligned toward the cup. Many golfers misalign the golf putter's face at incorrect angles, causing the golf ball to go off the desired track and miss the cup. The structure of this invention is attached tightly to the shaft of the putter about 3 inches above the putting face of the club.

The device has a rear extension member extending rearward and perpendicularly of the face of the club. A lateral extension member is attached at one end to the rear extension member and extends parallel to the face of the club so that its other end is at a point that is behind the area of the club face where it is most desirable to strike the ball. At such other end of the lateral extension member is a pivot on which an alignment member arm is pivotally mounted and extends forward, parallel to the rear extension member, to a point beyond the front of the face of the club where the alignment member arm then extends laterally on each side thereof to form a T-shaped structure. The alignment member at the end of the alignment member arm, when in use, is desired to be parallel to the front face of the golf club. A string member is attached to the alignment member arm and extends to a combination string tension member and target. The target is aligned directly along the string, and the string tension member has a spring coil therein which maintains very light tension on the string as the club is moved back and forth to keep the string taut between the string tension member and target and the alignment member arm.

To use of the device of this invention, one would place the putter behind a golf ball. The string member would then be centered over the top of the ball. The alignment member would then be automatically positioned perpendicular to the desired direction of travel of the ball. The golfer then aligns the face of the putter parallel to the alignment member. Once the club face is parallel to the alignment member, the putting stroke is then performed, with the golfer visually keeping the string over the center of the ball during the complete swing of the club. In this way when the club strikes the ball, the club face will be perpendicular to the desired direction of travel of the ball and the club will be moving towards the target. By practicing with the device of this invention, one can learn to keep his eyes on the ball during the complete stroke, have a proper swing path to the target and strike the ball with the putter face square to the hole.

DESCRIPTION OF THE PREFERRED EMBODIMENT(S)

Figure 1:
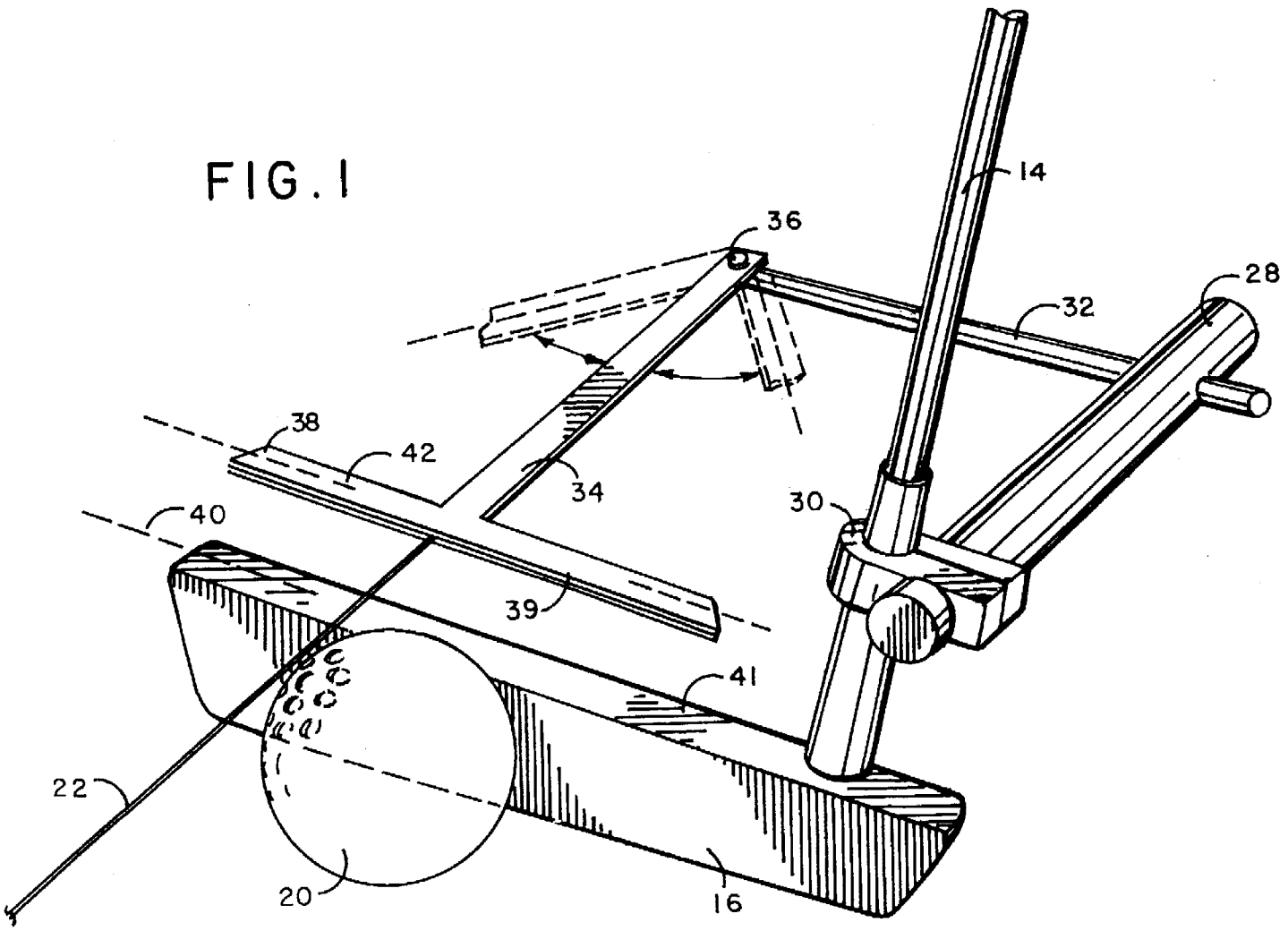
FIG. 1 illustrates a perspective view of the club attachment portion of the golf putter alignment teaching device of this invention attached to the shaft of a golf club with a golf ball disposed in front of the club.
Figure 2:
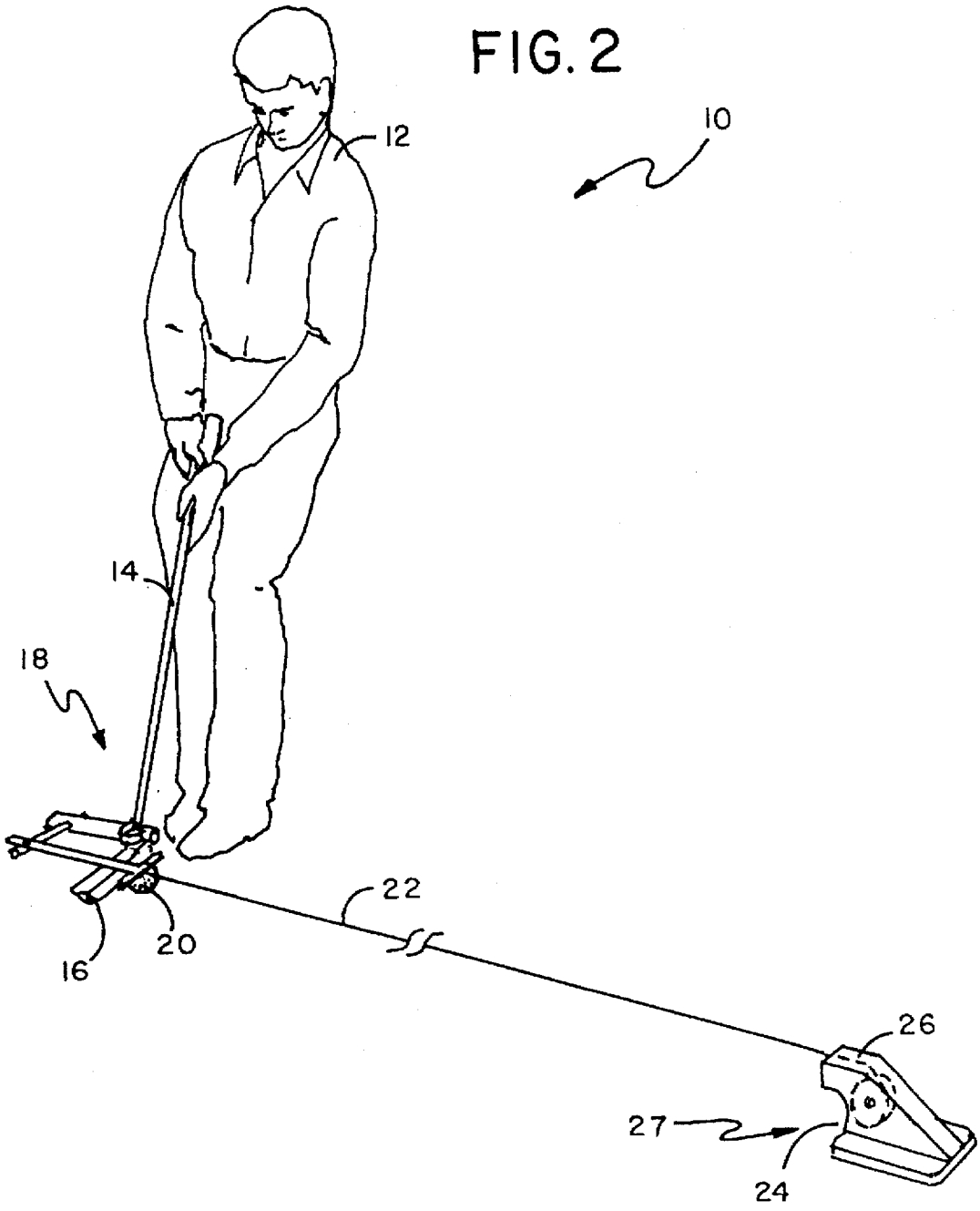
FIG. 2 illustrates a perspective view showing the club attachment portion attached by a string to the string tension member and target.

FIG. 1 illustrates the club attachment portion of the device of this invention which is attached to shaft 14 of a golf putter by shaft clamp member 30. The device extends rearward formed by rear extension member 28 which rearwardly extending extension member is generally perpendicular to putter face 16. Adjustably attached at one end of and within rear extension member 28 is lateral extension member 32. As will be described further below, the lateral positioning of the lateral extension member within rear extension member 28 can be adjusted. At the other end lateral extension member 32 is pivot member 36 which pivotally holds alignment member arm 34 which extends forward toward and beyond club face 16. Alignment member arm 34 is generally parallel to rear extension member 28 but since it pivots, as seen in its alternate positions by sections thereof in FIGS. 5 and 6, it can become misaligned therewith depending on the pull of string 22 which is attached to alignment member arm 34. Extending from the forwardmost end of the alignment member arm 34 and disposed perpendicularly thereto is alignment member 38 which extends laterally on each side thereof to form a T-shaped structure with the alignment member arm. Alignment member 38 has an axis 42 which, in one desired mode as will be described in further detail below, is to be disposed parallel to axis 40 of putter head 41. In practice, string 22 is positioned directly centered above golf ball 20, and the putter is moved so that axis 42 of the alignment member is aligned parallel to axis 40 of putter head 41 which is parallel to putter face 16 of the club. The tension on the string caused by the string tension member, seen in FIG. 2, causes string 22 to form a straight line between alignment member arm 34 and target 24. It should be understood that the target herein can also be a cup structure which could have a string tension member disposed thereabove. The combination string tension member and target 27 can have therein a spring member to cause string wind 26 to create very light tension on the string so that it does not slack and winds or unwinds, respectively, easily during any forward or rearward motion of the putter that occurs during the putting stroke. This design maintains alignment member arm 34 always in line with target 24. A string wind member 26 such as similar to that found in spring-wound measuring tapes and the like can be utilized such that the device could wind up the string within string tension member and target 27 and then pull the string out therefrom to a desired distance which would still allow free backwards and forwards movement of the putter yet still maintain very light tension on the string so that it taut and able to be centered above ball 20.

Figure 4:
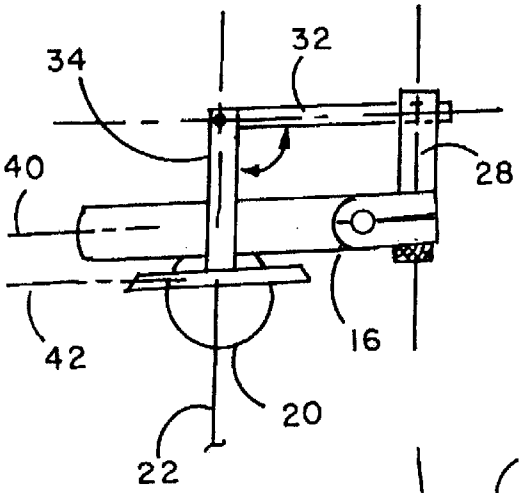
FIG. 4 illustrates a top diagrammatical view showing the axis of the alignment member disposed parallel to the axis of the club face.
Figure 5:
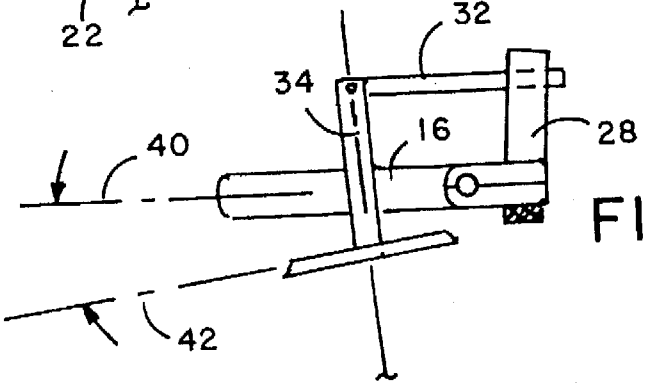
FIG. 5 illustrates a top diagrammatical view showing the alignment member misaligned with the club face.
Figure 6:
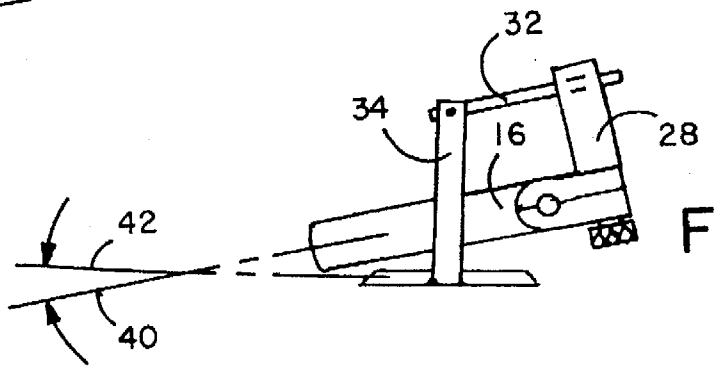
FIG. 6 illustrates a top diagrammatical view showing the alignment member misaligned with the club face.
Figure 7:
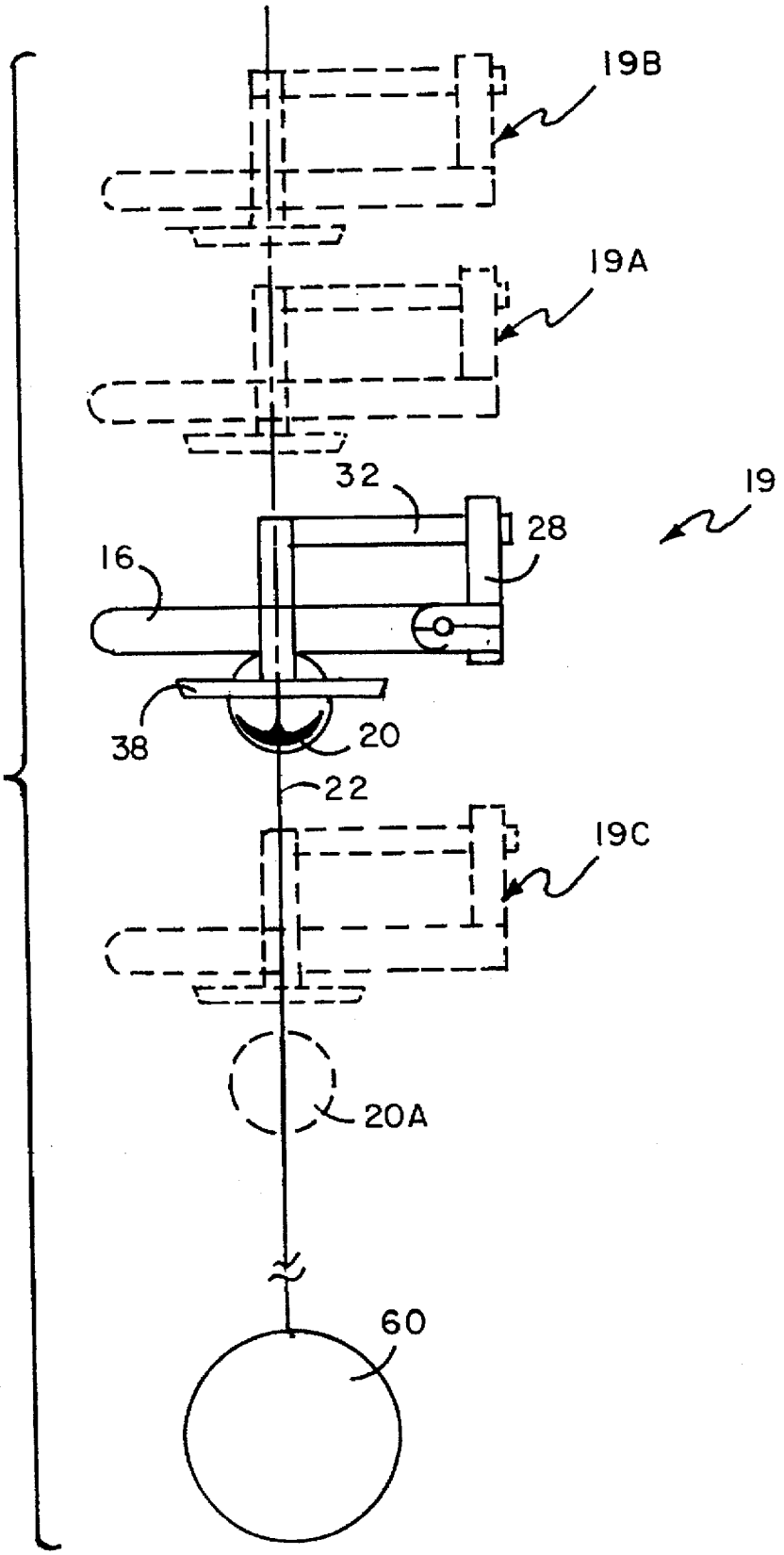
FIG. 7 illustrates a top diagrammatical view of the string staying over the center of the ball during a complete swing.

The device operates on the principle that with alignment member 38 postioned somewhat in advance of putter face 16, it can be viewed from above by golfer 12 so that he can align the putter face properly. When axis 42 of alignment member 38 is aligned parallel with axis 40 of putter head 41 and above the ball, then the ball will be struck with the putter face in perfect perpendicular alignment to the desired direction of the ball's travel which will be directly under string 22. When the golfer swings the putter back and forth, string 22 should always be over the center of the ball, as seen in FIG. 7. If, though, a misalignment should occur when the golfer sets up to putt the ball, for example as seen in FIG. 5 where the putter head axis 40 is out of alignment with the alignment member arm axis 42, the golfer can then realign the putter to bring it back into proper alignment as seen in FIG. 4. Another example of misalignment can occur when the club is at a different angle, such as seen in FIG. 6, and the golfer must then adjust the position of the club until the putter head face is in parallel alignment with the alignment member.

In order to learn the proper swing plane of the putter, which is straight back and then straight through toward the target or cup, one must visually observe the string to keep it centered over the ball during the complete swing of the club, as illustrated in FIG. 7. FIG. 7 shows putter face 16 first aligned parallel to alignment member 38 above ball 20 in position 19 with string 22 extending to the target or cup 60. In this Figure the backstroke is seen by the rearward positioning of the club and club attachment, designated first in dashed lines as position 19A and then further rearward as position 19B. String 22 is maintained in alignment directly above ball 20. One then swings the club forward, striking the ball at position 19 designated in solid lines and moves the putter forward to a position designated as 19C, seen also in dashed lines, striking ball 20 and causing it to move toward a target or cup 60, as illustrated by dashed ball 20A which is still aligned during its path of travel under string 22.

Figure 3:
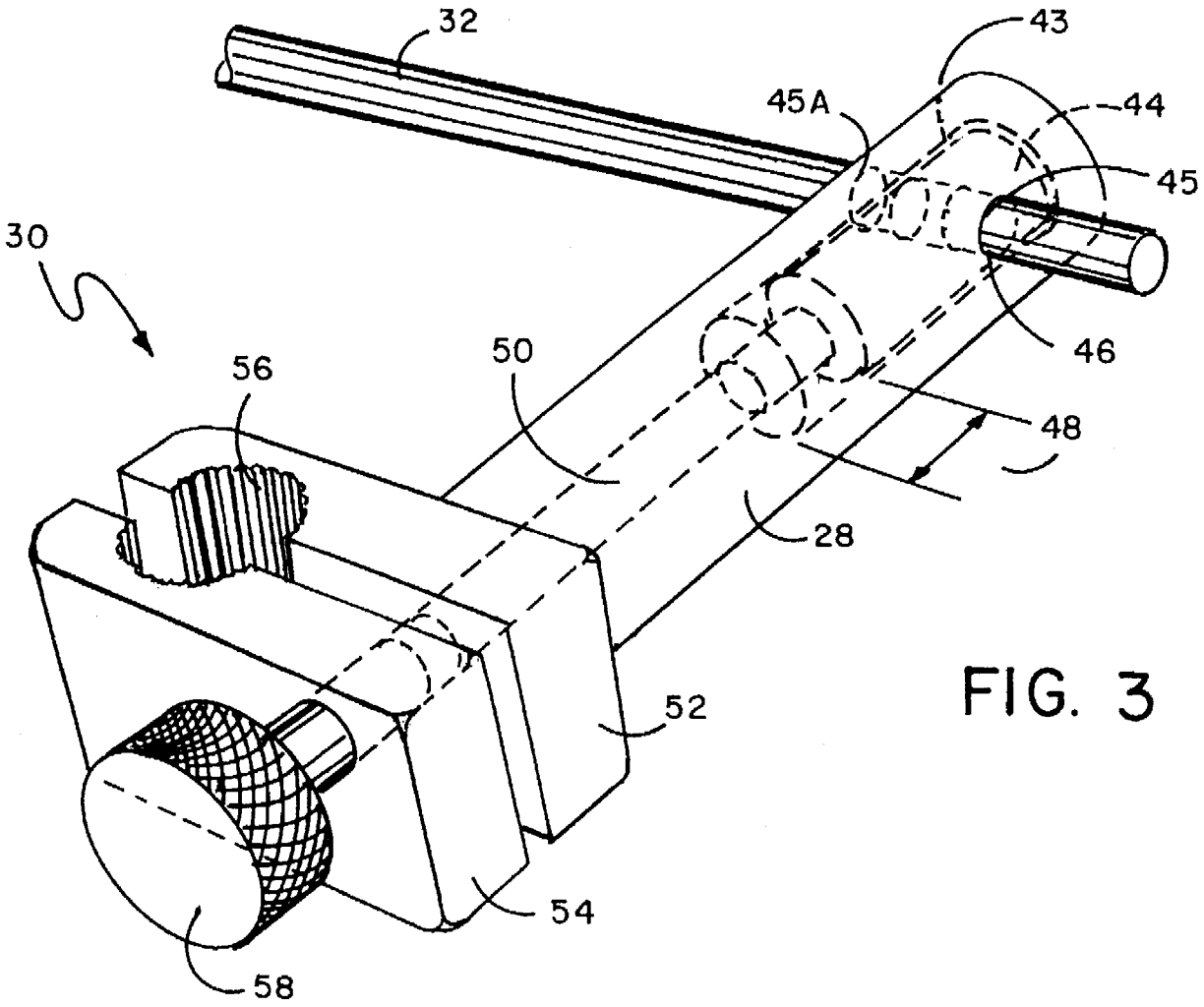
FIG. 3 illustrates the internal structure of the rear extension member and shaft clamp member.

FIG. 3 illustrates one mechanism for lateral adjustment and tightening in position of lateral extension member 32 within rear extension member 28. In FIG. 3 is seen first side 52 and second side 54 of shaft clamp member 30 which surround shaft receipt aperture 56 and which are tightenable against the shaft of the putter when placed within such aperture. A knob 58 can tighten on threaded shaft 50 to accomplish this tightening. At the same time that the shaft clamp 30 is tightened on the shaft, the threaded shaft 50 pulls tightening member 44 inward toward the shaft. Aperture 46 in tightening member 44 receives one end of lateral extension member 32. Lateral extension member 32 also extends through aligned first and second apertures 45 and **45*a* formed on both sides of rear extension member 28. Rotating knob 58 pulls tightening member 44 toward the shaft within tightening member chamber 43, thereby pulling lateral extension member 32 against the edges of first and second apertures 45 and 45*a* in rear extension member 28, thus locking it in place by pressure. Thus, rotating knob 58 tightens shaft clamp 30 on the putter head and at the same time also adjustably tightens lateral extension member 32 at its desired lateral position set by the user within rear extension member 28. It is important to provide for the adjustability of lateral extension member 32 since different putters can have a center or area on the putter head most desired to be used for putting different distances to the target, and this ability to laterally position lateral extension member 32 allows the device to be used on different putters. Other means of attaching lateral extension member 32 and adjusting its position on rear extension member 28 can be utilized in this device. Tightening knob 58 can be utilized not only in the position shown but also can be positioned at the other end of rear extension member 28** as long as its rotation causes the tightening of the clamp and securement of the lateral extension member in the rear extension member.

It also should be noted that in one embodiment alignment member arm 34 and alignment member 38 can be comprised of a stiff planar piece of transparent material such as plastic while the other members of the device other than the string can be composed of metal. Such transparent alignment member 38 can have a straight front edge and can have a darkened line 39 thereon, seen in FIG. 1, running parallel to the alignment member axis 42 so that it can be more easily seen by the golfer and so that alignment member 38 does not obscure front face 16 of the putter in order for it to be more easily aligned therewith.

Although the present invention has been described with reference to particular embodiments, it will be apparent to those skilled in the art that variations and modifications can be substituted therefor without departing from the principles and spirit of the invention.

I claim:

1. A teaching device for golf putting, said teaching device being removably securable to a golf putter having a putter face and vertically disposed shaft, said teaching device comprising:

clamping means for removably securing said teaching device in a generally horizontal plane relative to the vertically disposed shaft of the golf putter;

means adjustably carried by said clamping means for providing a pivot point spaced laterally of said clamping means, an alignment member supported at said pivot point in a horizontal plane;

said alignment member including an elongate portion having an elongated axis for placement in alignment with or parallel to a longitudinal axis of the putter face;

a target member;

elongate flexible guide means secured to said elongate portion of said alignment member for guiding a golf ball to said target member; and means for tensioning said guide means and maintaining tension on said guide means from said alignment member to said target member during a stroke of the putter.

2. The device of claim 1 comprising;

said clamping means including an attachment portion adapted to be secured to the club shaft, said alignment member being adapted to be supported above a face of the putter; and said elongate flexible guide means comprising a string member extending from said target member to said alignment member to maintain said alignment member aligned perpendicular to said string member irrespective of the directional positioning of the putter face wherein the golfer aligns the putter face with said alignment member to align the putter face perpendicular to the direction of travel of a golf ball to said target member and maintains said string over the center of the ball while swinging the club to maintain the club swing in the proper plane.

3. The device of claim 1 comprising:

said alignment member comprising a T-shaped member having a center point, said T-shaped member disposed above the putter face, said T-shaped member having a base member disposed perpendicular to the putter face and a top member disposed perpendicular to said base member; and said string member having a first end and a second end, said first end of said string member attached to said target member, said second end of said string member attached to said center point to permit pivotal movement of said alignment member such that said top member is maintained perpendicular to said string member which string member is aligned above the desired direction of travel of the golf ball so that when a golfer maintains said top member parallel to the putter face, it is perpendicular to the desired direction of travel of the golf ball and should said top member become non-parallel to the putter face, then the golfer can move the putter so that the putter face is parallel to said top member which, in turn, causes the putter face to be perpendicular to the desired direction of travel of the golf ball to said target, and said string being maintained by the golfer over the center of the ball while swinging the club back and forth to provide visual feedback to the golfer to keep the club in a proper swing plane.

4. The device of claim 1 comprising:

said means adjustably carried by said clamping means comprising a rear extension member having a first end and a second end;

means to attach said first end of said rear extension member onto the shaft of the golf putter such that said rear extension member extends rearwardly perpendicular to the putter face;

a lateral extension member having a first end and a second end, said first end of said lateral extension member attached to said second end of said rear extension member;

means to adjust the position of said lateral extension member in relation to said rear extension member;

a pivot member disposed on said second end of said lateral extension member;

said alignment member having an arm having a first end and a second end, said first end pivotally attached to said pivot member;

said alignment member being disposed perpendicular to said alignment member arm, said alignment member disposed above the putter face; and said string member having a first end and a second end, said first end attached to and centered over said target member, said second end of said string member attached to said second end of said alignment member arm such that said alignment member arm pivots to always be perpendicular to said string and the desired direction of travel of the golf ball wherein the golfer aligns the putter face parallel to said alignment member before putting to position the putter face perpendicular to said string member and wherein the golfer maintains said string over the center of the ball during back-and-forth swinging of the club toward said target to keep the club in the proper swing plane.

5. The device of claim 4 wherein said means to attach said first end of said rear extension member to the shaft comprises a manually tightenable clamp member.

6. The device of claim 4 wherein said alignment member arm and said alignment member are planar and made of transparent plastic.

7. The device of claim 6 wherein said alignment member has a straight front edge to be maintained parallel to the putter face of the golf club by the golfer.

8. The device of claim 7 wherein said means for tensioning said elongate flexible guide means further includes means to maintain very light tension on said string member to keep it taut at all times.

* * * * *